US005702205A

United States Patent [19]

Mahone et al.

[11] Patent Number: 5,702,205

[45] Date of Patent: Dec. 30, 1997

[54] STEEL CATENARY RISER SYSTEM FOR MARINE PLATFORM

[75] Inventors: William C. Mahone, Plano; Bruce D. Chandler, Houston; Joseph P. Killeen, Carrollton; David L. Garrett, Dallas, all of Tex.

[73] Assignee: Mobil Oil Corporation, Fairfax, Va.

[21] Appl. No.: 566,807

[22] Filed: Dec. 4, 1995

[51] Int. Cl.[6] ..... F16L 19/00; F16L 23/00; F16L 23/02; F16L 23/12

[52] U.S. Cl. ..... 405/169; 138/109; 285/412; 405/170

[58] Field of Search ..... 405/173, 195.1, 405/224.3, 169, 170; 166/350, 359, 367; 285/405, 412; 138/109

[56] References Cited

U.S. PATENT DOCUMENTS

| | | | |
|---|---|---|---|
| 3,557,564 | 1/1971 | Hauber | 405/169 |
| 4,717,287 | 1/1988 | Laursen | 405/169 |
| 4,810,133 | 3/1989 | Kopp et al. | 405/168 |
| 5,092,711 | 3/1992 | Langner | 405/169 |
| 5,269,629 | 12/1993 | Langner | 405/195 |

OTHER PUBLICATIONS

"Design and Installation of Auger Steel Catenary Risers", E.H. Phifer et al, OTC 7620, Houston, TX, May 2–5, 1994.

"A Hybrid Riser for Deep Water"; C.H. Alexander; OSEA—94113; Singapore; Dec. 6–9, 1994.

*Primary Examiner*—Tamara L. Graysay
*Assistant Examiner*—Tara L. Mayo
*Attorney, Agent, or Firm*—Malcolm D. Keen

[57] ABSTRACT

A marine riser system for a bottom-supported platform which can be installed by divers without the use of J-tubes or I-tubes. A flowline, e.g. steel pipeline, is laid between a subsea well or the like, and a jacket of a bottom-supported platform. The free end of the flowline is curved upwardly in a catenary amd is attached to the jacket at a depth which is below the turbulence zone but is one which is substantially above the marine bottom; preferably at a depth at which divers can safely work. After the flowline is structurally attached to the jacket, the free end of the flowline is fluidly connected (e.g. by divers) to a substantially vertical riser section which is clamped within the jacket and which extends through the turbulence zone to the surface.

8 Claims, 3 Drawing Sheets

STEEL CATENARY RISER SYSTEM FOR MARINE PLATFORM

DESCRIPTION

1. Technical Field

The present invention relates to a marine riser system and a method for installing same in a body of water and in one of its aspects relates to a steel catenary riser (SCR) system wherein one end(s) of a rigid, (e.g. steel) submerged pipeline (s) is curved upward in a catenary from the marine bottom and is affixed to the jacket of a bottom-supported platform at a depth which is below the surface-action zone of the body of water but one which is above the marine bottom, preferably at a depth at which divers can safely and economically work. After the catenary riser section of the pipeline(s) is affixed to the jacket, the catenary riser section is then fluidly connected to a vertical riser section(s) (e.g. by divers) which, in turn, extends upward along the jacket to deck facilities which lie above the surface of the water.

2. Background Art

In producing hydrocarbons and the like from marine deposits, it is common to use a single, bottom-supported, production platform to produce a plurality of submerged sources, e.g. subsea wells, gathering manifolds, etc., which lie on the marine bottom. Flowlines, e.g. steel pipelines, are laid across the marine bottom from the fluid sources to the platform where they are connected to a riser system which carries the produced fluids to deck facilities above the surface of the body of water. The particular riser systems may take various forms but typically they include multiple conduits through which the various produced fluids (e.g. oil, gas, water, etc.) flow from the marine bottom to the surface. A "riser" or "riser system", as used throughout herein, may also include conduits used as off-loading lines, fluid injection lines and service, electrical, and/or hydraulic control lines (e.g. umbilical lines).

Where a bottom-supported platform is installed in shallower waters, it is common to use divers to install a retrofitted conventional associated riser system; i.e. a vertical riser system which is installed after the platform has been installed wherein pipe clamps are used to affix the vertical riser to the jacket. That is, the pipelines are laid along the marine bottom between the wells and the lower end of the platform jacket where divers then connect the horizontal pipelines to the vertical riser sections which, in turn, are attached to and extend along the jacket to the surface. While the use of divers in the installation, inspection, and maintenance of the riser significantly reduces the overall costs of installing and maintaining the riser system, the actual costs involved are still substantial.

Similar type risers are also installed at platforms in deeper waters but since divers can not operate safely and/or economically at such depths, most connections at or near the bottom of the platform jacket must be made with remote controlled vehicles (ROV) or the like. As will be understood by those skilled in the art, the use of ROV's does not only substantially increase the costs involved in the installation and maintenance of such risers but also, most connections made with ROV's are potentially less reliable as those manually made and inspected by divers.

Another well known and commonly-used technique for installing risers at bottom-supported, deep water platforms (which does not require the use of a ROV) involves the use of "J-tube(s)". A "J-tube" is a guide conduit which is affixed to the jacket of the platform and extends from the surface to near the lower end of the jacket. The lower end of the J-tube is curved at a radius which allows a pipeline to be drawn therethrough without crimping or otherwise seriously damaging the pipeline.

As a pipeline which is being laid horizontally from a well approaches the lower end of the platform jacket, the free end is pulled into and up through the J-tube to the surface thereby providing the "vertical" section of the riser through which the fluids are produced. "I-tubes" are also sometimes provided within the jacket to guide more flexible lines, i.e. umbilical control lines, etc., from the marine bottom vertically to the surface.

While "J-tubes" have been widely accepted for installing risers at fixed platforms in deep water, the J-tubes and/or I-tubes, themselves, are expensive to fabricate into a jacket and can add substantially to the overall costs of the platform and riser installation. Further, as will be recognized in the art, it is not uncommon to encounter problems during installation of a riser using J-tubes; e.g. the pipeline can bind within the tube as it is being pulled therethrough which may cause severe damage to the pipe and/or the J-tube. This can require expensive downtime and repair before the installation of the riser can be completed.

Recently, it has been proposed to lay a substantially rigid (e.g. steel) pipeline from a subsea well or other fluid source on the marine bottom with conventional submerged pipelaying techniques and then curve one end of the pipeline upward in a gentle catenary path through the "turbulence zone" and connect it directly to a floating vessel on the surface; see "Design and Installation of Auger Steel Catenary Risers", E. H. Phifer et al, OTC 7620, 26th Annual Offshore Technology Conference, Houston, Tex., May 2–5, 1994. These risers are commonly referred to as Steel Catenary Risers or "SCR's". As will be understood by those in the art and as used herein, the "turbulence zone" is that zone at and near the surface which is subject to surface and near-surface wave and current conditions which, in turn, can result in substantial forces being applied against any structure (i.e. unsupported pipelines, etc) which pass through or lie within this zone.

While SCR systems may offer some advantages over other known riser systems, the catenary portion of the rigid pipeline which passes through the turbulence zone still must undergo and withstand the significant forces exerted thereon. Accordingly, the pipe used for these catenary portions require additional wall thickness to counteract and withstand the fatigue and dynamic loads exerted thereon. Further, if the catenary portion of the pipeline becomes fatigue or damaged to the point of failure or possible failure, a large section of the submerged pipeline has to be replaced which is both expensive and extremely difficult to accomplish.

Another riser system which has recently been proposed (primarily for floating surface facilities) combines rigid (e.g. steel catenary risers (SCR)) and flexible flowlines to provide the necessary fluid communication between the marine bottom and the production facility on the surface. Basically, the steel catenary risers—which are merely the "free" ends of the pipelines being laid across the marine bottom—are curved upward through the water in a gentle catenary path to a large, submerged buoy, which, in turn, is moored to the bottom by tension leg, tether lines so that the buoy will lie at a depth below the turbulence zone of the water. Flexible flowlines are then connected to the steel catenary risers at the buoy and extend through the turbulence zone to the surface where they are connected to the production facility; see co-pending and commonly-assigned U.S. patent application Ser. No. 08/321,712, filed Oct. 12, 1994.

DISCLOSURE OF THE INVENTION

The present invention provides a reliable marine riser system for a bottom-supported platform which can be installed by divers or ROVs without the use of multiple riser clamps, J-tubes or I-tubes. As a flowline, e.g. steel pipeline, is laid across the marine bottom between a submerged fluid source, e.g. subsea well, and a bottom-supported platform, its free end (i.e. end adjacent the platform) is curved upwardly in a gentle catenary. The free end of the flowline is attached to the jacket at a depth which is below the turbulence zone but is substantially above the marine bottom. Preferably, this depth is one at which divers can safely and/or economically work.

After the flowline is attached to the jacket, the flowline is fluidly connected (e.g. by divers) to a substantially vertical riser section within the jacket which, in turn, extends from adjacent the flowline through the turbulence zone to deck facilities above the surface. The vertical section is attached to the jacket (e.g. with conventional clamps) which substantially negates the cyclic forces imposed thereon by the forces in the turbulence zone thereby alleviating the fatigue and extreme wear on the riser which might otherwise occur. By eliminating the need for (a) extending and clamping the vertical riser all the way to the marine bottom and (b) J-tubes and/or I-tubes, the present riser system is considered more reliable and can be installed and maintained at significantly less expense than other known riser systems which are now used in similar environments.

More specifically, the marine riser system of the present invention is comprised of one or more flowlines (e.g. relatively rigid, steel pipelines) which extend along the marine bottom of the body of water between a submerged fluid source(s) and the jacket of a bottom-supported platform. The pipeline(s) may be first connected to the source(s) and then laid toward the jacket wherein the free end thereof is curved upward to form a gentle catenary or steel catenary riser portion (SCR) or preferably, the free end of the pipeline(s) is first attached to the jacket after which the pipeline(s) is laid away from the platform to be connected to the submerged source(s). In the latter laying technique, the pipeline(s) will assume a natural catenary as it extends away from the platform towards the submerged source(s).

The free end of the flowline is connected to a tie-in structure or "porch" which, in turn, is affixed to the jacket at a depth which lies below the "turbulence zone" of the water body but is substantially above the marine bottom. Preferably, this depth is one at which divers can safely work (e.g. 50–150 meters). However, it should be recognized that in some instances, ROVs may be used if required or desired.

The particular construction of the tie-in porch is not critical to the present invention as long as the porch is positioned at the proper depth or location and is capable of securing the end of the flowline to the jacket. Likewise, the tie-in porch can be assembled (e.g. welded) onto the jacket during the original construction of the jacket or it can be retrofitted into an existing jacket as a particular situation dictates.

Basically, the tie-in porch is comprised of a frame having at least one receptacle mounted thereof. Each receptacle is comprised of a plate which has a slot therein for receiving the free end of a respective flowline, which, in turn, is preferably formed of a tapered stress joint to compensate for the stresses developed between the flowline and the receptacle. The tapered joint has a connecting fluid flange on the end thereof and an anchor flange positioned below said connecting fluid flange.

To install the present riser system, the flowline(s) is laid between submerged well(s) or the like and a bottom-supported platform using conventional marine pipeline laying techniques. If a flowline is laid from a well, the free end is pulled upward through a gentle catenary as the flowline approaches the platform jacket and is guided into the slot in a respective receptacle on the tie-in porch to seat the anchor flange thereon. The flowline is then secured (e.g. by divers) to the receptacle by positioning a retainer plate over the anchor flange and then bolting the retainer to the receptacle to retain the anchor plate therebetween. The riser system is completed (e.g. by divers) by installing fluid connectors between the connecting fluid flange on the now-secured flowline and a respective vertical conduit or riser section which, in turn, is attached to the jacket and which extends upward to the surface.

If a flowline is to be laid from the platform to a well, the free end of the flowline is first pulled into and attached to the receptacle in the same way as described above. As the flowline extends away from the platform, the flowline will inherently form a catenary between the tie-in porch and the marine bottom before it extends across the marine bottom to be connected to the submerged source.

BRIEF DESCRIPTION OF THE DRAWINGS

The actual construction, operation, and apparent advantages of the present invention will be better understood by referring to the drawings which are not necessarily to scale and in which like numerals identify like parts and in which.

BEST KNOWN MODE FOR CARRYING OUT THE INVENTION

Figure 1:
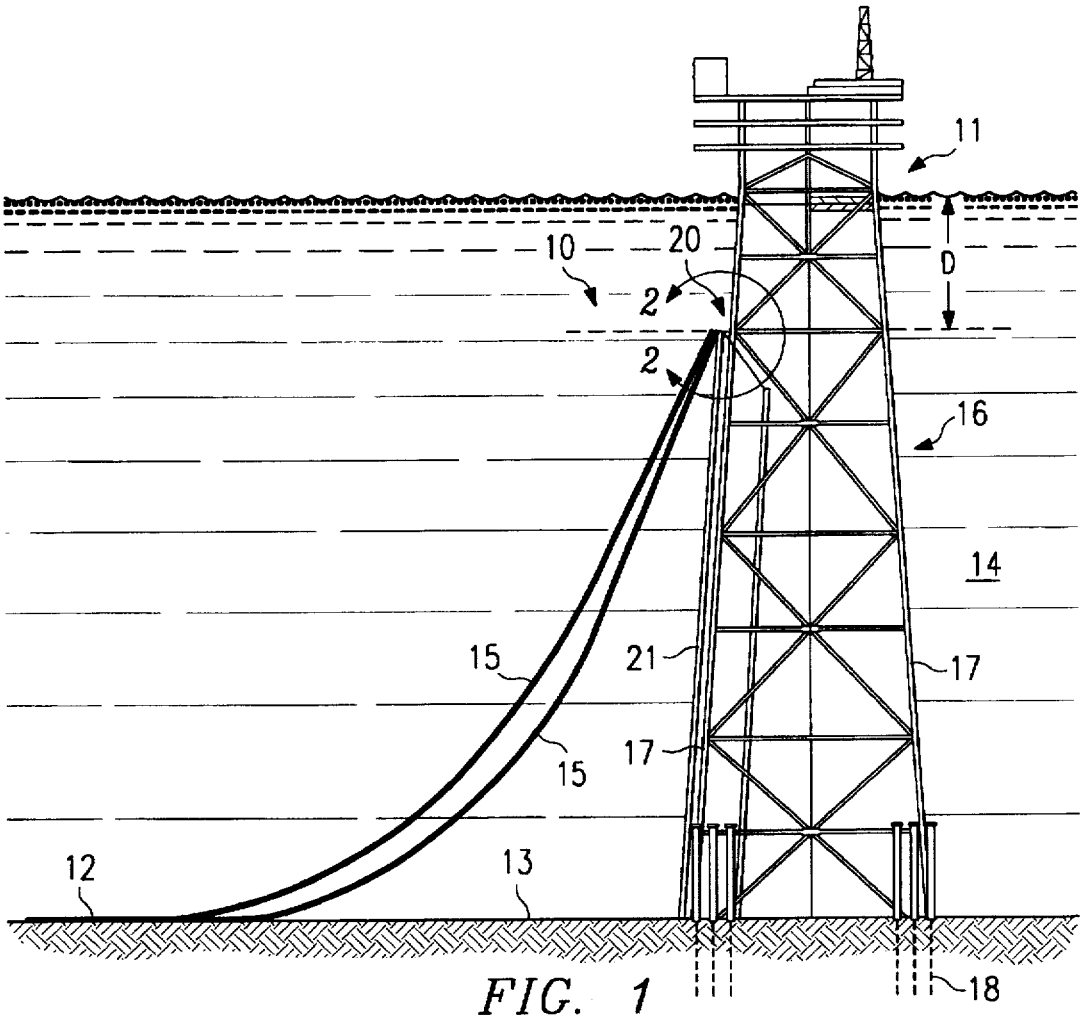
FIG. 1 is a perspective view of the present marine riser system installed in an operable position in a body of water at an offshore bottom-supported platform.

Referring more particularly to the drawings, FIG. 1 discloses the marine riser system 10 of the present invention which has been installed in an operable position at a deep-water, bottom-supported platform 11. Basically, riser system 10 is comprised of one or more flowlines (e.g. rigid steel pipelines) 12 which extend along the marine bottom 13 of the body of water 14 and which are adapted to be connected at one end to a respective fluid source such as a submerged well, a gathering manifold, other pipelines, submerged storage, etc. (not shown). As the flowlines approach platform 11, the other or "free" end of each of flowlines 12 is curved upward to form a gentle catenary or steel catenary riser portion (SCR) 15.

As will be understood by those skilled in the art, platform 11 may take different configurations but basically will be comprised of a jacket 16 which, in turn, is formed of legs 17 which are connected together with the appropriate cross bracing. Jacket 16 is constructed on shore and is typically floated in a horizontal position aboard a barge (not shown) to its destination. It is then offloaded and righted to a vertical position as it sinks to the marine bottom. Jacket 16 is typically anchored in position on the marine bottom 13 by piles 18 or the like.

In the present invention, tie-in structure or "porch" 20 is affixed to jacket 16 at a point which will lie at a depth "D" when jacket 16 is in an operable position within the body of water 14. Depth D is below the "turbulence zone" of the water body but is one which is substantially above the marine bottom 13. Preferably, depth D is one at which divers can safely and economically work (e.g. 50–150 feet).

As will be understood by those in the art and as used herein, the "turbulence zone" is that zone at and near the surface which is subject to surface and near-surface conditions which, in turn, can result in substantial forces being applied against any structure (i.e. unsupported pipelines, etc) which pass through or lie within this zone.

The particular construction of tie-in porch 20 is not critical to the present invention as long as the porch is positioned at the proper location or depth and is capable of securing the free ends of lines 12 to jacket 16. Likewise, tie-in porch 20 can be assembled (e.g. welded) onto jacket 16 during the original construction of the jacket or it can be retrofitted into an existing jacket as a particular situation dictates.

For example, many available deep-water platforms have reinforcing members 21 built-in to provide support for the jacket when the platform is in its horizontal position on a barge(s) prior to launch. Since the upper ends of members 21 often lie substantially at depth "D", the bracing which tie the tops of members 21 into jacket 16 forms a natural point for mounting porch 20. Porch 20 can be retrofitted onto an existing platform (e.g. by divers) if the platform is already in place or can be fitted to the platform at the surface before it is launched.

Referring now to FIGS. 2–8, a preferred construction of tie-in porch 20 is illustrated. Porch 20 is comprised of a frame 22 having one or more receptacles 23 (two shown) mounted thereof. Each receptacle 23 is comprised of an upwardly-angled plate 24 which has a slot 25 therein (FIG. 6) for receiving the free end of a flowline 12, as will be explained fully below. A stop element 26 is positioned on either side of slot 25 at the front thereof and a plurality of holes 27 are radially-spaced around plate 24 for a purpose to be discussed later.

The free or terminal end of flowline 12 (i.e. the end of the catenary riser portion 15) is preferably formed of a tapered Stress joint **15*a* (FIG. 7) which, in turn, has a constant internal diameter (I.D.) but has an outer diameter (O.D.) which increases uniformly from its lower end 15*b* to its upper or free end 15*c*. Illustrative of such a tapered joint is one having a constant I.D. of 5.375 inch while its O.D. increases from 6.625 inch at 15*b* to 8.172 inch at 15*c* through a length of 22 feet 6 inch. This tapering of the joint provides additional stiffness to compensate for the increased bending moments expected to be experienced by SCR 15 below the connection point between the joint and the porch 20. Tapered stress joint 15*a* has a connecting fluid flange 28 at its upper end and an anchor flange 29 fixed thereto at a short distance (e.g. 18 inches) below connecting fluid flange 28 (see FIGS. 5, 7, and 8**).

To install the riser system of the present invention, flowline(s) 12 is laid between submerged wells or the like (not shown) and platform 11 in either direction using conventional and well known marine pipeline laying technique. Tapered joint **15*a* is affixed to the end of SCR 15 on line 12 to form the terminus of the flowline as the laying of the flowline approaches or moves away from platform 11. The free end 15*c* of line 12 is pulled upward to form a gentle catenary 15 in the line and it is guided into slot 25 in plate 24 of a respective receptacle 23 on tie-in porch 20. Tension on line 12 is then relaxed to allow anchor flange 29 to seat onto the top of plate 24 where it is temporarily held in place by stops 26 on either side of slot 25**.

Figure 8:
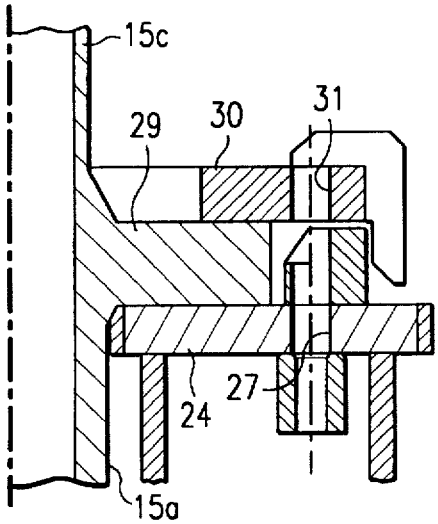
FIG. 8 is a sectional view taken along line 8—8 of FIG. 5.
Figure 2:
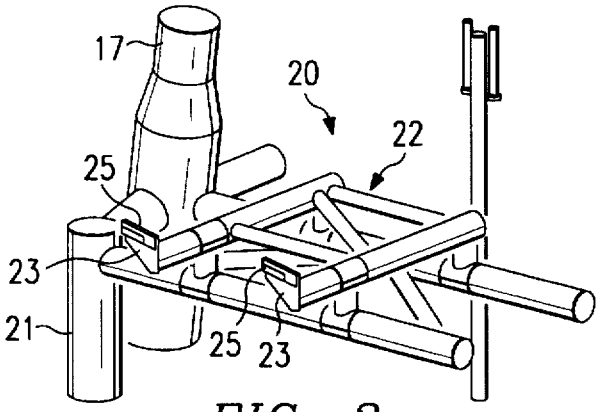
FIG. 2 is a perspective view taken within the arc line 2—2 of FIG. 1 of structure for attaching the flowlines to the jacket of the bottom-supported platform.
Figure 3:
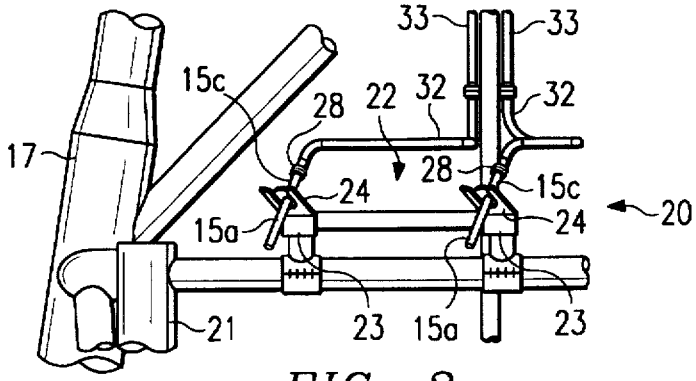
FIG. 3 is an elevational view of the structure of FIG. 2 showing the fluid connectors and spool pieces with the flowlines being removed.
Figure 4:
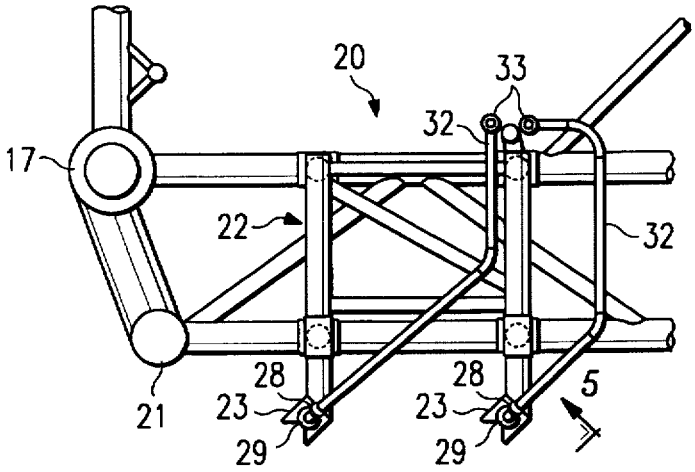
FIG. 4 is a plan view of the structure of FIG. 2 including the spool pieces and fluid connectors.
Figure 5:
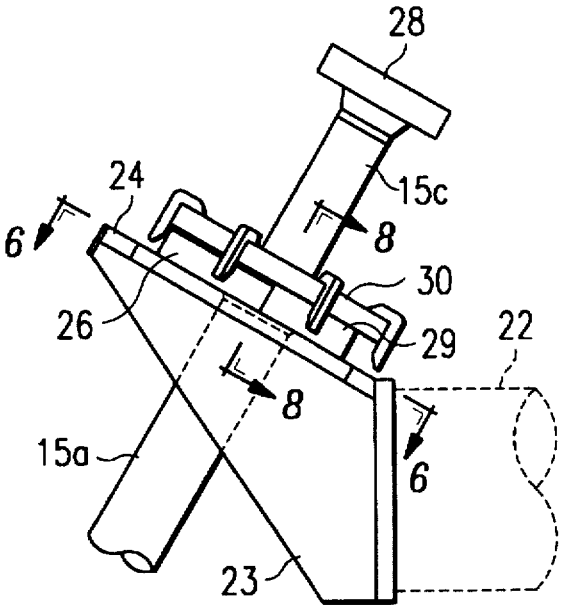
FIG. 5 is an enlarged, elevational view taken along line 5—5 of FIG. 4.
Figure 7:
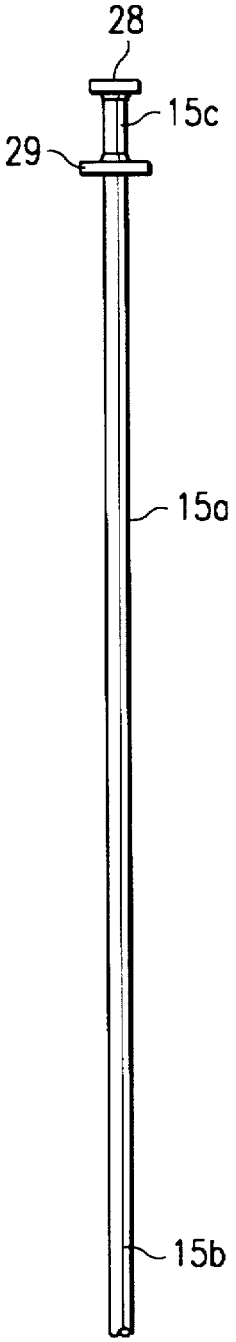
FIG. 7 is an elevational view of a tapered stress joint which forms the free end of the flowline which is to be attached to the platform of FIG. 1.
Figure 6:
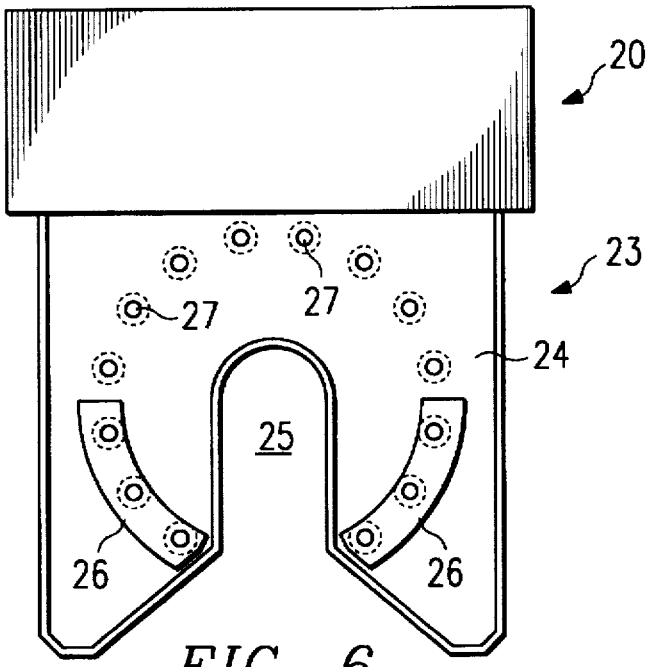
FIG. 6 is a plan view taken along line 6—6 of FIG. 5 with the flowlines removed.

Line 12 is secured in receptacle 23 (e.g. by divers) by positioning retainer plate 30 over anchor flange 29 and securing it in place by bolts (not shown) through aligned holes 31 in retainer 30 and 27 in plate 24 (see FIG. 8). This provides a positive structural connection between the flowline 12 and the jacket 16 of platform 11. The riser system is completed (e.g. by divers) who next install fluid connectors (e.g. spool pieces 32) between the connecting fluid flanges 28 on lines 12 and respective vertical conduits 33 which, in turn, are attached to the jacket and which extend upward to the surface.

Again, it is pointed out that porch 20 is at a depth D which is below the surface tubulence zone but is a depth at substantially above the marine bottom and is preferably at a depth at which divers can safely and economically work. Accordingly, the flowlines 12 (e.g. rigid steel pipelines) are not subjected to the significant forces within the turbulence zone. Therefore, no substantial length of flowlines 12 need to have additional wall thickness since no portion of the lines will undergo the forces present in the turbulence zone. Further, since divers can be used in most instances to carry out the connections and inspections at porch 20, the resulting riser system is more reliable and less expensive than conventional riser systems which include (a) vertical sections which have to be clamped to the jacket all the way to the marine bottom and/or (b) J-tubes and/or I-tubes.

What is claimed is:

1. A marine riser system comprising:

a platform jacket positioned onto the marine bottom of a body of water;

a tie-in structure mounted on said jacket and lying at a depth below the turbulence zone of said body of water but at a depth which is substantially above said marine bottom, wherein said tie-in structure comprises:

a frame attached to said jacket at said depth;

a receptacle on said frame, said receptable comprising: a plate having a slot therein;

at least one flowline on said marine bottom having one end curving upward through a catenary from the marine bottom to said tie-in structure; and wherein said one end of said at least one flowline includes:

a tapered joint forming the terminus of said one end of said at least one flowline;

a connecting flange on the end of said tapered joint; and an anchor flange on said tapered joint positioned below said connecting flange; and means for structurally connecting said one end of said at least one flowline within said slot in said plate of said tie-in structure.

2. The marine riser system of claim 1 wherein said at least one flowline comprises a steel pipeline.

3. The marine riser system of claim 1 wherein said depth is a depth at which divers can safely work.

4. The marine riser system of claim 1 including:

a substantially vertical riser section on said jacket and extending substantially from said depth to the surface of said body of water; and means for fluidly connecting said at least one flowline to said riser portion.

5. The marine riser system of claim 1 wherein said means for connecting said one end of said at least one flowline to said tie-in structure comprises:

means for connecting said anchor flange on said tapered joint to said plate of said receptacle.

6. The marine riser system of claim 5 wherein said means for connecting said one end of said at least one flowline to said tie-in structure comprises:

a retainer plate positioned onto said anchoring flange; and means for connecting said retainer plate to said plate of said receptacle.

7. The marine riser system of claim 1 wherein said tie-in structure is mounted onto the jacket before said jacket is positioned in said body of water.

8. The marine riser system of claim 1 wherein said tie-in structure is mounted onto the jacket after said jacket is positioned in said body of water.

* * * * *